United States Patent [19]

Summers

[11] Patent Number: 4,457,974

[45] Date of Patent: Jul. 3, 1984

[54] BICOMPONENT FILAMENT AND PROCESS FOR MAKING SAME

[75] Inventor: James T. Summers, Chattanooga, Tenn.

[73] Assignee: E. I. Du Pont de Nemours and Company, Wilmington, Del.

[21] Appl. No.: 168,152

[22] Filed: Jul. 14, 1980

[51] Int. Cl.[3] ..... D02G 3/04

[52] U.S. Cl. ..... 428/373; 428/374; 264/171

[58] Field of Search ..... 428/373, 374; 264/171

[56] References Cited

U.S. PATENT DOCUMENTS

| | | | |
|---|---|---|---|
| 3,068,204 | 12/1962 | Perry et al. | 528/279 |
| 3,117,906 | 1/1964 | Tanner | 428/373 X |
| 3,418,200 | 12/1968 | Tanner | 264/171 X |
| 3,489,641 | 1/1970 | Harcolinski et al. | 264/171 X |
| 3,681,910 | 8/1972 | Reese | 428/373 X |
| 4,118,534 | 10/1978 | Stanley | 428/373 X |

*Primary Examiner*—Roland E. Martin, Jr.

[57] ABSTRACT

A bicomponent filament of nylon and polyester having a reduced tendency to pre-split, said filament being substantially free from antimony or any other material that will form a deposit on the walls of the spinneret aperture, and the process of preparing said filament. The filament has a substantially uniform cross sectional dimension throughout its length.

3 Claims, No Drawings

BICOMPONENT FILAMENT AND PROCESS FOR MAKING SAME

BACKGROUND OF THE INVENTION

This invention relates to bicomponent textile filaments of nylon and polyester, the components of which adhere to each other during fiber processing, but may be split into component parts after fabrication into fabric. This invention also relates to a process of producing such bicomponent textile filaments.

Bicomponent textile filaments of nylon and polyester are known in the art, and are described in Tanner U.S. Pat. No. 3,117,906. Stanley U.S. Pat. No. 4,118,534 also discloses and claims such filaments, and teaches that the tendency of such filaments to presplit (i.e. split before the filaments are made into fabric) can be reduced by including in the nylon component aminopropylmorpholine and bis-hexamethylenetriamine. Nishida U.S. Pat. No. 3,917,784 discloses bicomponent nylon/polyester filaments, and teaches that the adhesion between the components can be improved by use of a particular type of spinning oil.

The present invention is also directed at a solution to the problem of pre-splitting of the bicomponent fiber into its components. Pre-splitting is a problem that can arise during fiber windup or in weaving or knitting whenever external stresses exceed component adhesion. Pre-splitting of bicomponent filaments is believed to have been one of the major reasons that nylon/polyester bicomponent fibers have not become of greater commercial significance.

It has now been found that the problem of pre-splitting can be largely overcome by employing a polyester component in the fiber that is substantially free of any ingredient that, under the conditions of spinning, is capable of reacting with any ingredient in the nylon component and precipitating as a deposit on the inside wall of the spinneret capillary. Some of the most common ingredients in polyester resins that are capable of reacting with nylon to form a precipitate on the inside wall of the spinneret capillary are antimony compounds; antimony compounds are an ingredient in most commercial catalysts used to produce textile polyester resins. When a polyester containing such an ingredient is spun through a spinneret aperture with nylon, the precipitate forms and deposits along the junction line of the two polymers, and the spinneret aperture gets smaller at the junction line leading to a shorter junction line and thus a weaker junction line and one more likely to pre-split. When a polyester containing an antimony compound is employed in the production of bicomponent fibers with nylon, the precipitate which forms contains a high concentration of antimony compounds. This change in cross sectional shape of the filament gives rise to a second problem, namely a nonuniformity or streak problem in the final fabric, for when a fabricator produces a fabric, several different bobbins of yarn are employed, and fiber cross sectional differences between two different bobbins are often optically apparent in the fabric. The product of this invention is a nylon/polyester bicomponent filament which is substantially free from antimony. The product of this invention is a nylon/polyester bicomponent filament that has substantially the same cross sectional dimensions throughout its length.

It is more economically attractive to use a polyester that is substantially free from any ingredient that is capable of reacting with nylon and precipitating as a deposit, that it is to stop the spinning and remove the deposit.

DETAILED DESCRIPTION

Suitable polyester resins for use in making the bicomponent filament of this invention can be made by use of a catalyst that does not contain an ingredient that will precipitate when brought into contact with nylon under spinning conditions. A suitable class of catalyst is alkyl titanate esters in which the alkyl group has 2 to 10 carbon atoms, for example, tetraisopropyl titanate, tetrabutyl titanate, tetraisobutyl titanate and the like. Another suitable class of catalysts are the fluotitanates, for example, potassium fluotitanate. Suitable polyesters include poly(ethylene terephthalate), polytetramethylene terephthalate, poly-1,4-dimethylcyclohexane terephthalate, and copolyesters such as poly(ethylene terephthalate) containing small amounts of 5(sodiumsulfo)isophthalate or similar compounds as disclosed in U.S. Pat. No. 3,018,272 to Griffing et al. Such polyesters will, of course, be of suitable fiber forming molecular weight; for example, in the case of poly(ethylene terephthalate), the relative viscosities should be in the range of about 19 to 40 as measured by dissolving 2.15 g of polymer in 20 ml of a solvent consisting of trichlorophenol (7 parts) and phenol (10 parts) at 140° C. for 30 minutes, and cooling the solution to 25° C. for 20 minutes before dropping it through the viscometer.

Suitable nylons for use in the present invention are well known in the art and include polyhexamethylene adipamide, poly(epsiloncaproamide), poly(hexamethylene sebacamide), and copolyamides. Such nylons will have relative viscosities in the range of about 30 to 70 (preferably 45 to 55) as measured at 25° C. using 1.0972 g of polymer in 10 ml of 90% formic acid.

Suitable spinneret aperture shapes include a round, trilobal, heart, tetralobal, and ribbon, such shapes are illustrated in the Tanner U.S. Pat. No. 3,117,906 and the Stanley U.S. Pat. No. 4,118,534.

Suitable apparatus for the production of bicomponent filaments is shown in Breen U.S. Pat. No. 3,117,362, and in Cancio U.S. Pat. No. 3,320,633.

The ratio of polyester to polyamide in the bicomponent fibers may vary over wide limits but in general the ratio will be in the range of 15 and 85 to 85 to 15, preferably 30 to 70 to 70 to 30.

The fiber of the present invention is processed in a conventional manner, in that after emerging from the spinneret it is attenuated and quenched, and drawn several times its original length. Such a conventional procedure is shown in Example 1 of Breen U.S. Pat. No. 3,117,362. The fiber is then wound on a roll in the conventional manner. After weaving or knitting, fabric formed from the fiber of this invention may be split into its components by treating in aqueous caustic solution at about 100° C. as taught by Stanley U.S. Pat. No. 4,118,534.

In the following examples, which illustrate the invention, all parts and percentages are by weight unless otherwise specified.

EXAMPLE I

Side by side bicomponent filaments were produced from poly(hexamethylene adipamide) having a relative viscosity of about 50, measured as described above, and poly(ethylene terephthalate) having a relative viscosity of about 26, measured as described above. The poly(ethylene terephthalate) was made by use of about 235 parts per million of tetraisopropyl titanate catalyst. The polymers were melted separately and the melts were led separately to the holes of a spinneret of the type shown in FIG. 3 of Cancio U.S. Pat. No. 3,320,633. The two polymers were fed to the spinneret holes in a ratio by weight of 45% polyamide and 55% polyester. The composite filaments had an oblong cross section of the type disclosed and claimed in FIG. 2 of Stanley U.S. Pat. No. 4,118,534, the cross sections being characterized by a length:width ratio of about 3.0. The molten filaments leaving the spinneret were attenuated by winding them up at about 500 yards per minute after being quenched with cross-flow air at ambient temperature. The final undrawn yarn consisted of 34 filaments at 25 denier each, the polyamide component being 11.3 denier and the polyester component 13.8 denier.

The filaments were spun continuously for 3 days, and the cross sectional dimensions of the filaments produced after 3 days were indistinguishable from the fiber produced during the first hour. The spinneret was examined after spinning and no deposits had formed on the walls of the spinneret apertures. Examination of the wound filaments showed only very minor pre-splitting had occurred.

In a comparative run, the fibers were produced from a similar polyamide and a similar polyester, only this time the polyester was produced with an antimony trioxide catalyst (about 300 parts per million of antimony). After 3 days, the filaments were examined and compared to filaments spun during the first hour; the cross sectional dimensions of the filaments had changed. The spinneret was examined and deposits containing antimony were found on the walls of the spinneret apertures. Examination of the filaments showed that the filaments were pre-split to a much greater extent than were the filaments made using as the polyester polymer, a polymer made with tetraisopropyl titanate catalyst.

In another comparative run, fibers were produced from a similar antimony-containing polyester and a different polyamide, poly(epsiloncaproamide). After 3 days the filaments were examined and compared to filaments spun during the first hour; and cross sectional dimensions of the filaments had changed as in the previously described comparative run. The spinneret was examined and deposits containing antimony were again found on the walls of the spinneret apertures. Examination of the filaments showed that the filaments pre-split to a much greater extent than did the filaments made using as the polyester polymer, a polymer made with tetraisopropyl titanate catalyst.

EXAMPLE II

Poly(ethylene terephthalate) was prepared from 20.43 kg dimethyl terephthalate and 13.6 kg ethylene glycol charged to an autoclave along with 3.1 g (150 ppm) zinc acetate exchange catalyst and 3.3 g (160 ppm) potassium fluotitanate polymerization catalyst using procedures well known to those skilled in the art. The polymer prepared had a relative viscosity of about 27.

Bicomponent filaments were spun from the above poly(ethylene terephthalate) and poly(hexamethylene adipamide) as described in Example I. After 35 hours of spinning, the cross section had not changed and no deposits had formed on the walls of the spinneret apertures.

This experiment was repeated using a poly(ethylene terephthalate) polymer containing about 250 parts per million antimony (added as $Sb_2O_3$ as polymerization catalyst). After 26 hours spinning, the filament cross section was noticeably distorted and even more distorted after 36 hours spinning. Examination of the spinneret capillaries showed significant deposits had formed.

I claim:

1. A process for the production of nylon/polyester bicomponent filaments which comprises simultaneously spinning through the same spinneret capillary, nylon and polyester, said polyester being substantially free of a compound which will react with the nylon to form a deposit on the walls of the spinneret capillary.

2. A bicomponent filament of nylon and polyester which is substantially free of antimony.

3. A bicomponent filament of nylon and polyester having substantially the same cross sectional dimensions throughout its length.

* * * * *